US006343997B1

(12) United States Patent
Allen

(10) Patent No.: US 6,343,997 B1
(45) Date of Patent: Feb. 5, 2002

(54) GOLF CLUB HANDLE APPARATUS AND A DOUBLE-HANDLED GOLF CLUB WITH FOREARM SUPPORT

(76) Inventor: Don Allen, 4406 Oxford Way, Norman, OK (US) 73072

( * ) Notice: Subject to any disclaimer, the term of this patent is extended or adjusted under 35 U.S.C. 154(b) by 0 days.

(21) Appl. No.: 09/628,189

(22) Filed: Jul. 28, 2000

(51) Int. Cl.[7] ..... A63B 53/14; A63B 53/16

(52) U.S. Cl. ..... 473/212; 473/294; 473/295; 473/296; 473/299

(58) Field of Search ..... 473/201, 212, 473/213, 214, 294, 549, 558, 560, 561, 563, 564, 565, 566, 567, 516, 518, 300, 295, 298–299; 623/65; D21/725, 727, 728, 756, 757

(56) References Cited

U.S. PATENT DOCUMENTS

| | | | | |
|---|---|---|---|---|
| 1,919,221 A | | 7/1933 | Janes | |
| 2,204,974 A | | 6/1940 | Strasser | 273/77 |
| 2,325,525 A | | 7/1943 | Lukenbill | |
| 3,036,831 A | | 5/1962 | Engan | |
| 3,462,155 A | | 8/1969 | Pelz | |
| 3,951,416 A | | 4/1976 | Koch et al. | |
| 4,215,860 A | | 8/1980 | Nakamatsu | |
| 4,911,725 A | * | 3/1990 | Duvieilh | |
| 5,037,103 A | | 8/1991 | Williams et al. | 173/183 R |
| 5,145,179 A | | 9/1992 | Breed | 273/189 R |
| 5,248,146 A | | 9/1993 | Viets | |
| 5,401,022 A | | 3/1995 | McCready | |
| 5,501,464 A | | 3/1996 | Dalbo | 273/187.2 |
| 5,511,788 A | | 4/1996 | Manley et al. | 473/213 |
| 5,529,306 A | | 6/1996 | Staats et al. | 473/208 |
| 5,606,772 A | | 3/1997 | Ilic | 16/114 R |
| 5,669,823 A | | 9/1997 | McCready | 473/294 |
| 5,711,716 A | | 1/1998 | O'Brien et al. | 473/212 |
| 5,799,995 A | | 9/1998 | Bergam et al. | 294/27.1 |
| 5,851,156 A | | 12/1998 | Schwark, Jr. | 473/201 |
| 5,873,147 A | | 2/1999 | Hintz | 16/110 R |
| 5,902,189 A | | 5/1999 | Schultz | 473/212 |
| 5,904,624 A | | 5/1999 | Martinez | 473/212 |

* cited by examiner

*Primary Examiner*—Stephen Blau
(74) *Attorney, Agent, or Firm*—Blank Rome Comisky & McCauley LLP

(57) ABSTRACT

A golf club handle apparatus is used with a golf club having a longitudinally extending hand grip and includes an elongated shaft, a handle structure, a forearm support member and a connector. The shaft extends along a longitudinal axis and has a first portion, a second portion and an intermediate portion disposed between the first and second portions. The handle structure includes a pair of handles connected to the intermediate portion and spaced apart from one another in a generally parallel relationship with the shaft positioned between the pair of handles. Each one of the pair of handles extends along a respective handle axis that is oriented generally perpendicularly to the longitudinal axis. The forearm support member is connected to the first portion and has a forearm support surface spaced apart and facing away from the shaft. The connector is disposed at the second portion and is operative to connect the hand grip of the golf club and the golf club handle apparatus together. Another embodiment of the invention integrates the golf club handle apparatus with a conventional golf club.

32 Claims, 3 Drawing Sheets

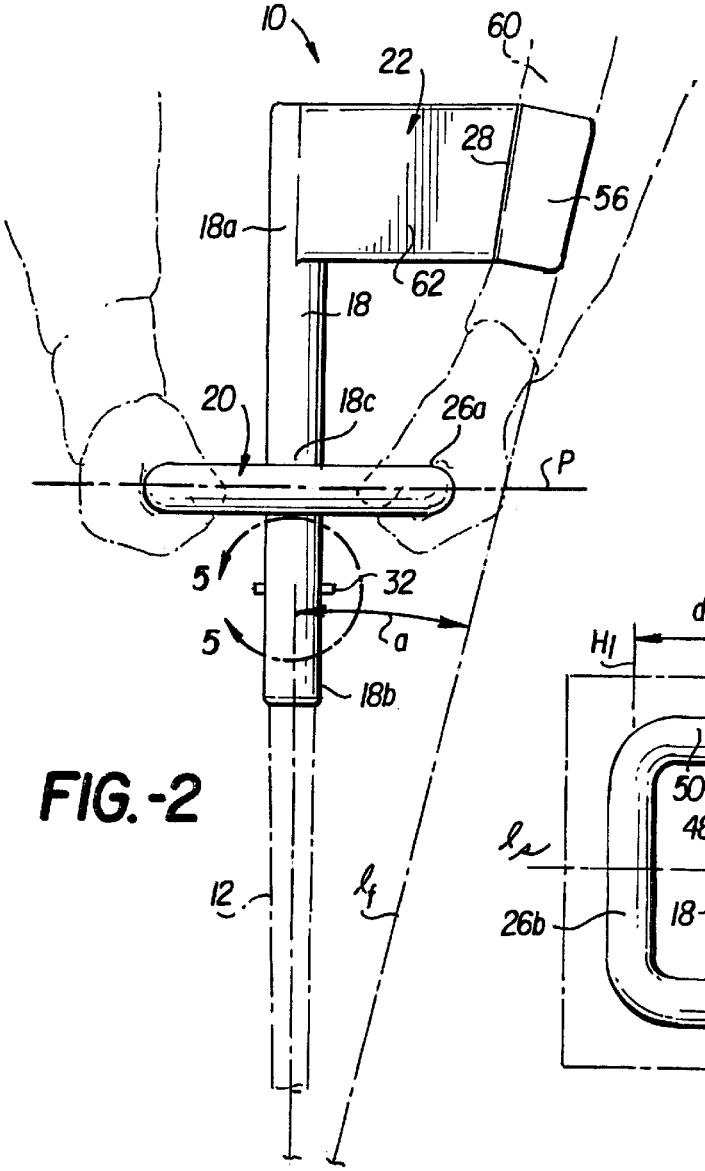
FIG.-2
FIG. 10
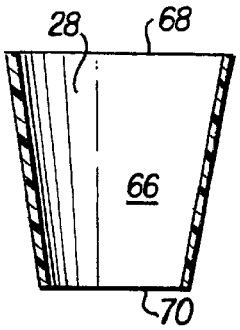
FIG. 4
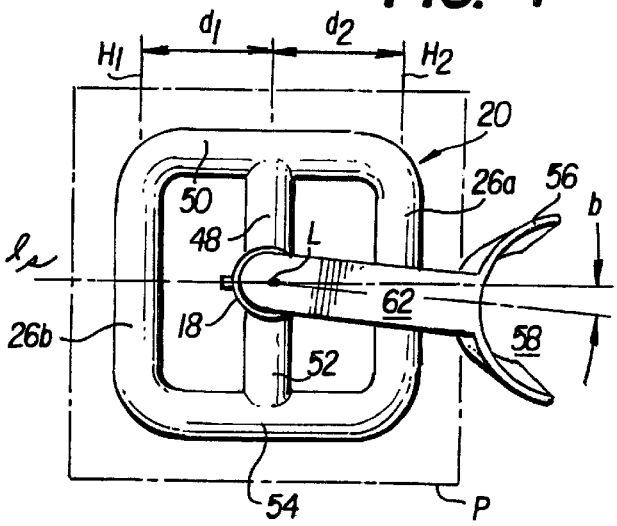
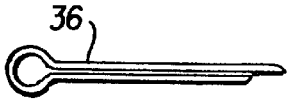
FIG. 6
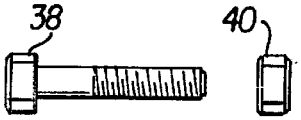
FIG. 7
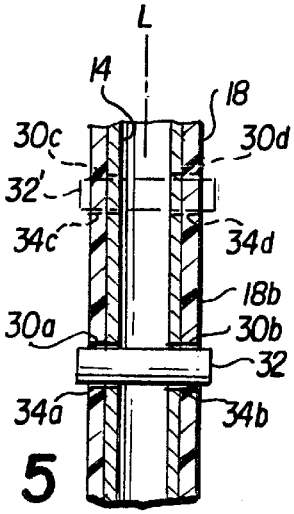
FIG. 5
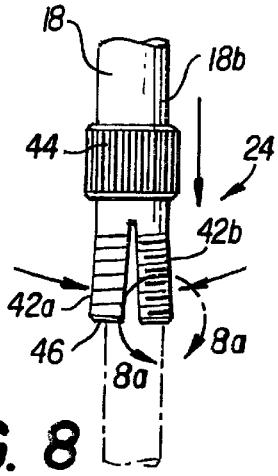
FIG. 8

GOLF CLUB HANDLE APPARATUS AND A DOUBLE-HANDLED GOLF CLUB WITH FOREARM SUPPORT

FIELD OF THE INVENTION

The invention relates to a golf club handle apparatus. More particularly, the invention is directed to a golf club handle apparatus that can be removed from or integrated with a golf club which includes a pair of handles straddling a golf club shaft and a forearm support structure for the leading arm of a golfer.

BACKGROUND OF THE INVENTION

It has been reported that over 2 million people per year being playing a golf as a pastime. Simultaneously, as many people quit playing golf as a pastime. As a result, the sport of golf has no growth. It is believed that the reason so many people quit the sport of golf is because of the degree of difficulty in playing a respectable golf game.

A key for playing a respectable game of golf is the golfer's ability to properly swing the golf club. Many types of devices have been designed for training or improving a golfer's swing. U.S. Pat. No. 3,951,416 disclose a golf training device that connects to a conventional golf club. A clamped portion of the golf training device engages the grip of the golf club adjacent the end of the club. A laterally spaced forearm clamp portion receives the golfers' trailing arm to maintain a fixed triangular relationship defined by the golfers' arm, club grip and golf training device. The triangular relationship prevents breaking of the trailing arm wrist on short swings, particularly putting.

U.S. Pat. NO. 5,248,156 discloses a putting trainer device that includes a plate with two opposing inverted U-shaped channels that depend angularly from each end of the plate. The plate has a hole where an attachment pin is inserted for attaching the plate to the grip end of the putter. The plate and U-shaped channels assures proper spacing of the golfers' arm during training.

U.S. Pat. No. 5,501,464 teaches a gold swing forearm/wrist positioner that maintains a predetermined triangular relationship between the forearms and elbows of a golfer as the golfer swings the golf club. A cuff member is adapted to be secured on one of the forearms of the golfer and connected to one end of a spacer at the other end which is pressed by the golfers' other forearm for improving the golfers' swing.

U.S. Pat. No. 3,462,155 teaches a golf club designed to be swung in a pendulum style between the legs of the golfer holding the club. The club includes a pair of horizontally parallel handled with each handle being gripped by the golfers' hands.

OBJECTS AND SUMMARY OF THE INVENTION

It is an object of the invention to provide a golf club handle apparatus for a golf club that assists a golfer, particularly a novice, in persistently striking a golf ball with the golf club.

It is another object of the invention to provide a golf club handle apparatus that assists a golfer, particularly a novice, in striking the golf ball for straight flight.

It is a further object of the invention to provide a golf club handle apparatus for a golf club that assists a golfer, particularly a novice, in striking the golf ball without inducing a hook effect or a slice effect.

Accordingly, a golf club handle apparatus for use with a golf club is hereinafter described. The golf club handle apparatus of the invention includes an elongated shaft, a handle structure, a forearm support member and a connector. The elongated shaft extends along a longitudinal axis and has a first portion, a second portion and an intermediate portion disposed between the first and second portions. The handle structure includes a pair of handles connected to the intermediate portion and spaced apart from one another in a generally parallel relationship with the shaft positioned between the pair of handles. Each one of the pair of handles extends along a respective handle axis that is oriented generally perpendicularly to the longitudinal axis. The forearm support member is connected to the first portion and has a forearm support surface spaced apart and facing away from the shaft. The connector is disposed at the second portion and is operative to connect a hand grip of the gulf club and the golf club handle apparatus together.

Another embodiment of the invention is a golf club that includes an elongated golf club shaft, a golf club head and a handle structure. The golf club shaft extends along a longitudinal axis and has a head section and a handle section disposed opposite the head section. The golf club head is connected to the head section. The handle structure is connected to the handle section which has an upper handle portion and a lower handle portion. The lower handle portion is disposed between the upper handle portion and the golf club head. The handle structure includes a pair of handles in a forearm support member.

The pair of handles are connected to the lower handle portion and are spaced apart from one another in a generally parallel relationship with the handle section of the golf club shaft positioned between the pair of handles. The pair of handles are disposed in a plane oriented generally perpendicularly to the longitudinal axis. The forearm support member is connected to the upper handle portion and has a forearm support surface spaced apart and facing away from the handle section of the golf club shaft.

BRIEF DESCRIPTION OF THE DRAWINGS

These and other objects of the invention will become more readily appreciated and understood from consideration of the following detailed description of the exemplary embodiments of the invention when taken together with the accompanying drawings, in which:

FIG. 2 is an enlarged front elevational view of the golf club handle apparatus of the invention being gripped by the golfer.

FIG. 4 is a top planar view of the golf club handle apparatus of the invention.

FIG. 5 is a partial elevational view in cross section illustrating cotters connecting the golf club handle apparatus of the invention with the hand grip of the golf club.

FIG. 6 is a side elevational view of a cotter pin.

FIG. 7 is a side elevational view of an exemplary connector of the golf club handle apparatus of the invention.

FIG. 8 is a from elevational view of an exemplary connector of the golf club handle apparatus of the invention.

FIG. 10 is a rear elevational view taken along line 10–10 in FIG. 9 of a sleeve of the forearm support member.

DETAILED DESCRIPTION OF THE EXEMPLARY EMBODIMENTS

Figure 3:
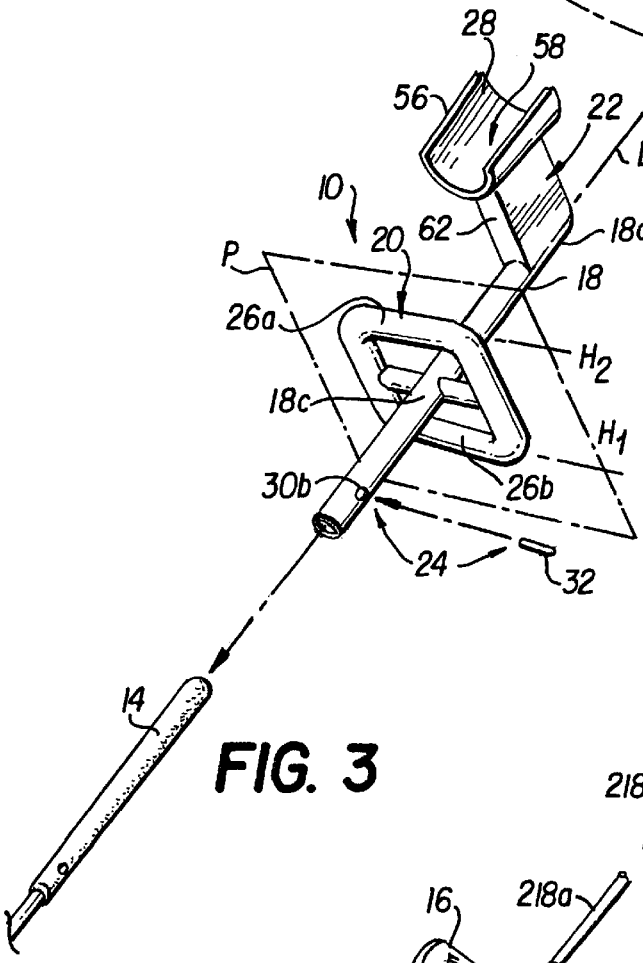
FIG. 3 is an exploded perspective view of the golf club handle apparatus of the invention.

A first exemplary embodiment of a golf club handle apparatus 10 of the invention is introduced in FIGS. 1–5. The golf club handle apparatus 10 of the invention is used with a conventional golf club 12 that has a longitudinally extending hand grip 14 and a golf club head 16. As best shown in FIGS. 2–4, the golf club handle apparatus 10 of the invention includes an elongated shaft 18, a handle structure 20, a forearm support member 22 and a connector 24.

In FIG. 2, the shaft 18 extends along a longitudinal axis L and has a first portion 18*a*, a second portion 18*b* and an intermediate portion 18*c*. The intermediate portion 18*c* is disposed between the first portion 18*a* and the second portion 18*b*. The shaft 18 is fabricated from a rigid material such as metal, composite or any other type of material commonly used for golf club shafts.

With reference to FIGS. 3 and 4, the handle structure 20 includes a pair of handles 26*a* and 26*b*. Although not by way of limitation, each one of the pair of handles 26*a* and 26*b* had a straight cylindrical construction and is also fabricated from a rigid material such as metal or composite. As best shown in FIG. 3, the pair of handles 26*a* and 26*b* are connected to the intermediate portion 18*c* of the shaft 18. The pair of handles 26*a* and 26*b* are spaced apart from one another in a generally parallel relationship with the shaft 18 positioned between the pair of handles 26*a* and 26*b*. Each one of the pair of handles 26*a* and 26*b* extends along a respective one of handle axes $H_1$ and $H_2$. As illustrated in FIG. 4 the handle axes $H_1$ and $H_2$ are oriented parallel to one another and generally perpendicularly to the longitudinal axis "L".

In FIG. 3, the forearm support member 22 is connected to the first portion 18*a* of the shaft 18. The forearm support member 22 has a forearm support surface 28 that is spaced apart and faces away from the shaft 18. The connector 24 is disposed at the second portion 18*b* of the shaft 18. The connector 24 is operative to connect the hand grip 14 of the golf club 12 and the golf club handle apparatus 10 of the invention together.

With reference to FIGS. 3 and 5, the second portion 18*b* of the shaft 18 defines a hollow tube. As best shown in FIG. 5, the hollow tube is sized and adapted to slidably receive the hand grip 14 of the golf club 12. The second portion 18*b* includes at least one pair of aligned holes 30*a* and 30*b*. The pair of aligned holes 30*a* and 30*b* extend radially relative to the longitudinal axis L and through the second portion 18*b* to form a component of the connector 24 (FIG. 3). Further, the connector 24 includes at least once cotter 32 that is sized and adapted to extend through the pair of aligned holes 30*a* and 30*b* and through radially-aligned hand grip holes 34*a* and 34*b* (formed in the hand grip 14 of the golf club 12) when the hand grip 14 is received by the second portion 18*b* of the shaft 18. Although not by way of limitation, the cotter 32 is fitted into and through the pair of aligned holes 30*a* and 30*b* and the hand grip holes 34*a* and 34*b* to secure the golf club handle apparatus 10 of the invention to the hand grip 14 of the golf club 12. For additional security, an additional pair of aligned holes 30*c* and 30*d* and additional hand grip holes 34*c* and 34*d* (drawn in fathom) are radially aligned and extend through respective ones of the hand grip 14 in the second portion 18*b* of the shaft 18. An additional cotter 32' (drawn in phantom) can be forced fitted into and through the additional aligned holes 30*c* and 30*d* and the additional hand grip holes 34*c* and 34*d* to provide a secure connection of the golf club handle apparatus 10 of the invention with the golf club 12.

One of the ordinary skill in the art would appreciate that other types of cotters can be used in lieu of the ones illustrated in FIG. 5. By way of example only, a conventional cotter pin 36 shown in FIG. 6 can be used. Alternatively, by way of example only, a conventional bolt 38 and a conventional nut 40 threadably engageable with each other as shown in FIG. 7 can also be used as a cotter.

Figure 8A:
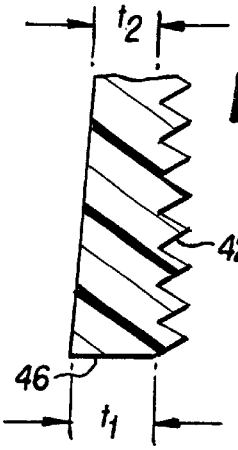
FIG. 8A is an enlarged view taken from FIG. 8 showing an enlarged cross-sectional view of a threaded arcuate segment of the connector.

A skilled artisan would comprehend that the cotters shown in FIGS. 5–7 can be used to effectively connect the golf club handle apparatus 10 of the invention permanently or semi-permanently to the golf club 12. However, the connector 24 can be designed to effectively install the golf club handle apparatus 10 of the invention onto the golf club 12 in a temporary manner. Although many different types of temporary connectors can be used to temporarily connect the golf club handle apparatus 10 of the invention onto the golf club 12, one example of a temporary connector 24 is illustrated in FIGS. 8 and 8A. Here, the connector 24 includes a pair of threaded arcuate segments 42*a* and 42*b* and a threaded collar 44 that are threadably engageable with each other. The pair of threaded arcuate segments 42*a* and 42*b* are connected to and extend distally from the second portion 18*b* to define a handle grip receiving opening 46. The threaded collar 44 is disposed about the second portion 18*b* of the shaft 18. However, as the collar 44 threadably engages with the pair of threaded arcuate segments 42*a* and 42*b*, the threaded collar 44 also becomes disposed about the pair of arcuate segments 42*a* and 42*b* as well as both of the second portion 18*b* of the shaft 18 and the pair of threaded arcuate segments 42*a* and 42*b* . The collar 44 is adapted for mateable, threadable engagement with the pair of threaded arcuate segments 42*a* and 42*b*. As the collar 44 advances in mateable engagement along the pair of threaded arcuate segments 42*a* and 42*b*, the handle grip receiving opening 46 becomes smaller. Conversely, as the collar 44 is withdrawn from threaded engagement with the pair of threaded arcuate segments 42*a* and 42*b*, the handle grip receiving opening 46 becomes larger. This occurs because at least one of the pair of threaded arcuate segments 42*a* and 42*b* has a longitudinally tapered thickness $t_1$ and $t_2$. The longitudinally tapered thickness $t_1$ and $t_2$ commences from the handle grip receiving opening 46 as $t_1$ and narrows towards the second portion 18*b* as $t_2$.

Although other types of handle structures 20 can be used with the golf club handle apparatus 10 of the invention, a preferred handle structure 20 is depicted in FIGS. 2–4. In FIG. 3, the respective handle axes $H_1$ and $H_2$ are disposed in a common plane P and this plane P is oriented substantially perpendicularly to the longitudinal axis (FIG. 2). Also, the pair of handles 26*a* and 26*b* are spaced apart equidistantly from the shaft 18 as shown in FIG. 4. In other words, the distance $d_1$ between the handle axis $H_1$ and the longitudinal axis L and the distance $d_2$ between the handle axis $H_2$ and the longitudinal axis L are equal.

The handle structure 20 includes a first attachment member 48 and a second attachment member 50 (FIG. 4). The second attachment member 50 is connected transversely to the first attachment member 48 to form a T-shaped configuration. The first attachment member 48 is connected to the intermediate portion 18*c* of the shaft 18 (FIG. 2) and the second attachment member 50 is connected to respective ones of the pair of handles 26*a* and 26*b*. It is preferred that each one of the pair of handles 26*a* and 26*b* is connected to the second attachment member 50 in a generally perpendicularly fashion.

The handle structure 20 also includes a third attachment member 52 and a fourth attachment member 54. The fourth attachment member 54 is connected transversely to the third attachment member 52 to form a T-shaped configuration. The third attachment member 52 is connected to the intermediate portion 18*c* of the shaft 18 (FIG. 2) in linear alignment as represented by line 1 with the first attachment member 48. The fourth attachment member 54 is connected to respective ones of the pair of handles 26*a* and 26*b* thereby forming a handle structure 20 surrounding the shaft 18. Each one of the pair of handles 26*a* and 26*b* is connected to the fourth attachment member 54 generally in a perpendicular fashion.

Figure 1:
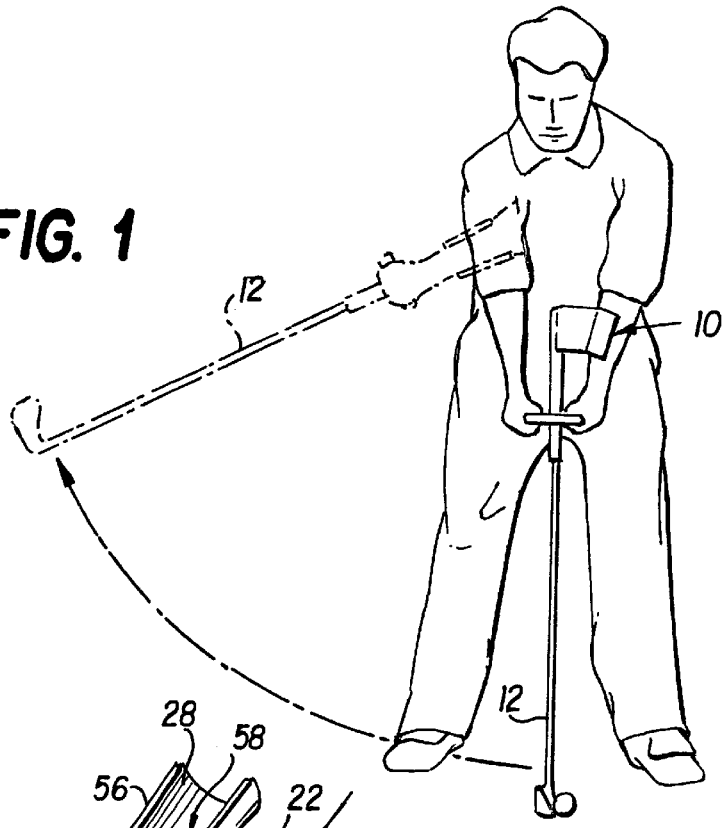
FIG. 1 is a front elevational view of a golfer gripping and swinging a golf club having a first exemplary embodiment of a golf club handle apparatus of the invention adapted thereto.

In FIG. 2, the forearm support surface 28 extends along an imaginary fall line $I_f$ which is inclined towards a selected one of the pair of handles 26*a* and 26*b*. By way of example only, the forearm support surface 28 extends along the imaginary fall line $I_f$ which is inclined towards the handle 26*a*. The imaginary fall line $I_f$ forms an acute angle a relative to the longitudinal axis L. Although not by way of limitation, the forearm support member 22 includes a cuff element 56 as shown in FIGS. 2–4. In FIGS. 3–4, the cuff element 56 is configured to form a concavity 58 which is sized and adapted to receive and contact a substantial portion of a user's, i.e. a golfer's, inner forearm 60 which is best illustrated in FIGS. 1 and 2. Also, the forearm support member 22 includes a spacer element 62 which is connected to and between the first portion 18*a* of the shaft 18 and the cuff element 56. The spacer element 62 assures that the user's inner forearm 60 is appropriately spaced apart from the shaft 18.

In FIG. 4, the forearm support member 22 is pivotally offset from an imaginary spacer line $I_s$ at an angle b. The space line $I_s$ extends through the longitudinal axis L and perpendicularly through each of the handle axes $H_1$ and $H_2$. It is preferred that angle b is in a range of approximately 0° and 10° towards the golfer's body when holding the golf club handle apparatus 10 of the invention. Preferably, angle b is 5°.

A skilled artisan would appreciate that the golf club handle apparatus 10 of the invention can be fabricated for either a left-handed golfer or aright-handed golfer by inclining the forearm support surface 28 towards a selected one of the pair of handles 26*a* and 26*b*. As shown in FIGS. 1 and 2, the golf club handle apparatus 10 of the invention is particularly suitable for a golfer with his/her arm in a leading position relative to the direction where the all is desired to be hit.

Figure 9:
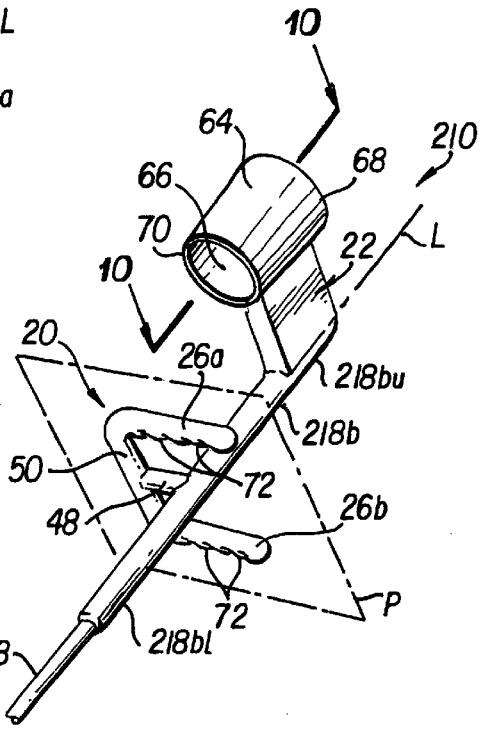
FIG. 9 is a second embodiment of the golf club handle apparatus of the invention having a different handle construction and a different forearm support member construction.

A second exemplary embodiment of a golf club handle apparatus 210 of the invention is introduced in FIG. 9. The second exemplary embodiment of the golf club handle apparatus 210 of the invention is similar to the one described above. However, rather than a cuff element 56, the golf club handle apparatus 210 of the invention has a sleeve 64. The sleeve is sized and adapted to receive and surround the user's forearm. The sleeve 64 defines a forearm receiving channel 66 that has enlarged opening 68 and a reduced opening 70 to form a truncated cone configuration as best shown in FIG. 10. The reduced opening 70 is positioned between a selected handle 26*a* or 26*b* in the enlarged opening 68.

Further, the handle structure 20 has a different shape and includes the first attachment member 48 and the second attachment member 50 which is connected transversely to the first attachment member 48 to form a T-shaped configuration. The first attachment member 48 is connected to the intermediate portion 18*c* of the shaft 18 with the second attachment member 50 connected to respective ones of the pair of handles 26*a* and 26*b* thereby forming a U-shaped configuration. Also, for the second exemplary embodiment of the golf club handle apparatus 210 of the invention, a plurality of finger recesses 72 are formed in each of the handles 26*a* and 26*b*.

Additionally, the golf club handle apparatus 210 of the invention is an integral construction with the golf club. Thus, a third exemplary embodiment of the invention is an integral club that includes an elongated golf club shaft 218, the golf club head 16 and the handle structure 20.

The golf club shaft 218 extends along the longitudinal axis L and has a head section 218*a* and a handle section 2218*b* which is disposed opposite the head section 218*a*. The golf 16 is connected to the head section 218*a* of the golf club shaft 218. The handle structure 20 is connected to the handle section 218*bu* and a lower handle portion 218*bl*. The lower handle portion 218*bl* is disposed between the upper handle portion 218*bu* and the golf club head 16.

The handle structure 20 includes the pair of handles 26*a* and 26*b* which are connected to the lower handle portion 218*bl* and are spaced apart from one another in a generally parallel relationship with the handle section 218*b* of the golf club shaft 218 positioned between the pair of handles 26*a* and 26*b*. The pair of handles 26*a* and 26*b* are disposed in the plane P which is oriented generally perpendicularly to the longitudinal axis L. The handle structure 20 also includes a forearm support member 22 which is connected to the upper handle portion 218*bu* and has a forearm support surface 28 that is spaced apart and faces away from the handle section 218*b* of the golf club shaft 218.

A fourth embodiment of a golf club handle apparatus 210 of the invention is illustrated in FIGS. 11–14. The fourth exemplary embodiment of the golf club handle apparatus 310 of the invention is similar to the first exemplary embodiment. However, a primary difference is that golf club handle apparatus 310 of the invention forms support member 322 that is releasably connected to the shaft 18 and is operative, when released from the shaft 18, to pivot about the longitudinal axis L. A spacer element 362 is designed differently than the spacer element 62 discussed above. This design change merely facilitates molding the forearm support member 322 as an integral construction.

Figure 12:
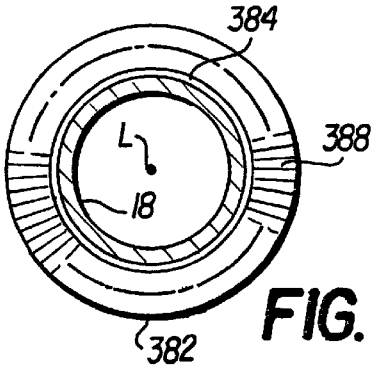
FIG. 12 is a planar view partially in cross section along line 12—12 in FIG. 13.
Figure 11:
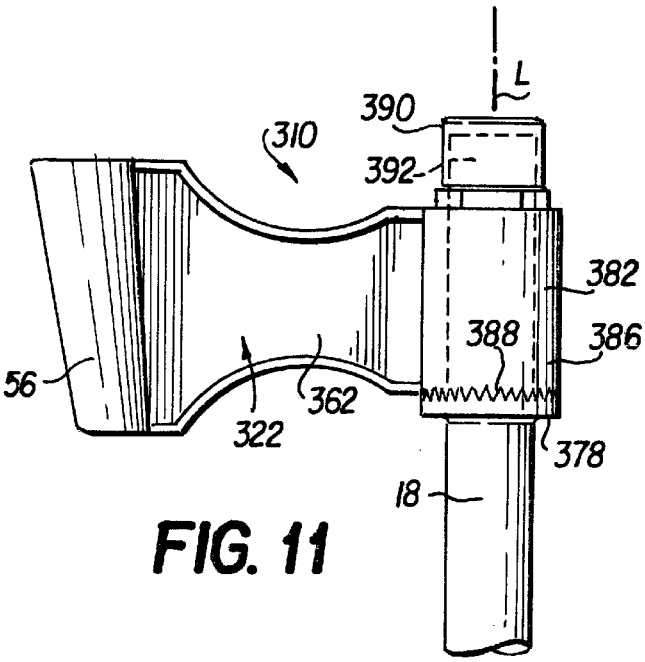
FIG. 11 is a side elevational view of a fourth exemplary embodiment of the golf club handle apparatus of the invention having a fore arm support member releasably connected to the shaft.

In FIG. 11, the shaft 18 includes a toothed collar 378. The toothed collar 378 is attached to the shaft 18 in a stationary manner relative thereto. The toothed collar 378 surrounds the shaft 18 and includes a plurality of radially extending gear teeth 380. The forearm support member 322 includes a tubular element 382 that is fixedly connected to the spacer element 362 element opposite the cuff element 56. The tubular element 382 defines an inner tubular channel 384 that is sized and adapted to slidably receive the shaft 18 as best shown in FIG. 12. The tubular element 382 has a tubular end portion 386 that has a plurality of radially extending gear teeth 388 that are adapted for mateable engagement with the plurality of gear teeth 380 380 formed in the tooth collar 378. The forearm support member 322 also includes a threaded cap 390 and the shaft 18 includes a threaded shaft end portion 392 that is mateably engageable with the threaded cap 390.

Figure 14:
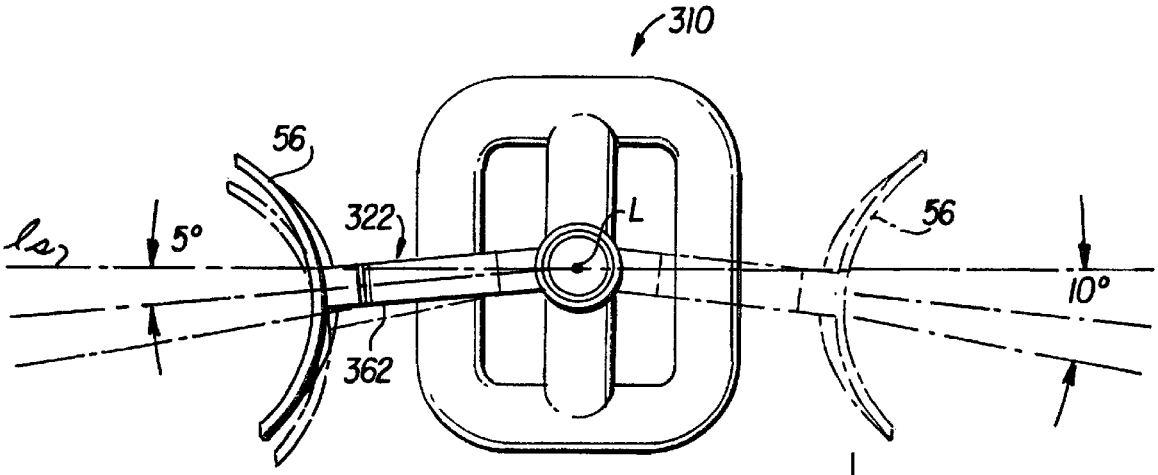
FIG. 14 is a top planar view illustrating by way of example only various positions of the forearm support member about the shaft.
Figure 13:
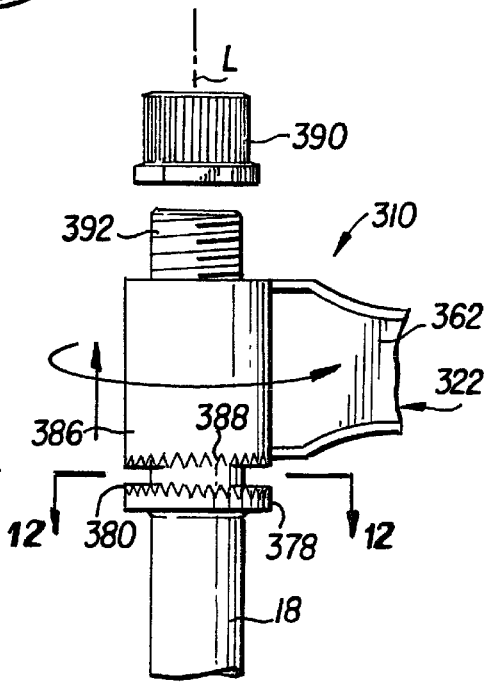
FIG. 13 is a side elevational view of the forearm support member in FIG. 11 disengaged from the shaft.

In FIG. 11, the threaded cap 390 is mateably engaged with the threaded cap end portion 392 which secures the forearm support member 322 to the shaft 18. In FIG. 13, the threaded cap 390 is disengaged from the threaded cap end portion 392 of the shaft 18 so that the user may disengage the mateable gear teeth to pivot the forearm support member 322 to a desired position about the longitudinal axis L of the shaft 18. As shown in FIG. 14, the forearm support member 322 can now be flipped-flopped for use by either a right-handed golfer or a left-handed golfer. Further, the forearm support member 322 can be secured to the shaft at a selected angle b relative to the imaginary shaft line $I_8$. As shown by way of example in FIG. 14, angle b can be 5° or 10° or can be pivoted anywhere about the longitudinal axis L in 5° increments.

With reference to FIGS. 1 and 2, the golfer is now capable of gripping the golf club similar to gripping a suitcase. Also, with this grip, the leading arm in the golfer's swing is supported at the golfer's inner forearm. As a result, a golfer, particularly a novice golfer, can now hit a golf ball persistently as compared to using a conventional grip. Also, it is intended that the invention assists the golfer in hitting the golf ball straight reducing the chances of inducing a hook effect or a slice effect.

The above-described exemplary embodiments of the invention have been described by way of example only. One of ordinary skill in the art would appreciate that modifications may be made to those exemplary embodiments without departing from the spirit and inventive concepts of the invention. For instance, other types and designs of handle structures may be used; other types and designs of connectors may be used; and, other types and designs of space elements and forearm support surfaces may be used.

I claim:

1. A golf club handle apparatus for use with a golf club having a longitudinally extending hand grip, the golf club handle apparatus comprising:

an elongated shaft extending along a longitudinal axis and having a first portion, a second portion and an intermediate portion disposed between the first and second portions;

a handle structure including a pair of handles connected to the intermediate portion and spaced apart from one another in a generally parallel relationship with the shaft positioned between the pair of handles, each one of the pair of handles extending along a respective handle axis oriented generally perpendicularly to the longitudinal axis;

a forearm support member connected to the first portion and having a forearm support surface spaced apart and facing away from the shaft; and a connector disposed at the second portion and operative to connect the hand grip of the golf club and the golf club handle apparatus together.

2. A golf club handle apparatus according to claim 1, wherein the second portion defines a hollow tube sized and adapted to slidably receive the hand grip of the golf club.

3. A golf club handle apparatus according to claim 2, wherein the second portion includes at least one pair of aligned holes extending radially relative to the longitudinal axis and through the second portion.

4. A golf club handle apparatus according to claim 3, wherein the connector includes at least one member and adapted to extend through the at least one pair of aligned holes and through hand grip holes formed in the hand grip of the golf club when the hand grip is received by the second portion.

5. A golf club handle apparatus according to claim 4, wherein the at least one member is one of a nut and bolt and a cotter pin.

6. A golf club handle apparatus according to claim 1, wherein the connector includes a pair of threaded arcuate segments connected to and extending distally from the second portion to define a handle grip receiving opening and a threaded collar disposed about at least one of the second portion, the pair of threaded arcuate segments and both the second portion and the pair of threaded arcuate segments and adapted for mateable engagement with the pair of threaded arcuate segments.

7. A golf club handle apparatus according to claim 6, wherein as the threaded collar is advanced in mateable engagement along the pair of threaded arcuate segments, the handle grip receiving opening becomes smaller and, as the threaded collar is withdrawn from threaded engagement with the pair of threaded arcuate segments, the handle grip receiving opening becomes larger.

8. A golf club handle apparatus according to claim 6, wherein at least one of the pair of threaded arcuate segments has a longitudinally tapered thickness commencing from the handle grip receiving opening and narrowing towards the second portion.

9. A golf club handle apparatus according to claim 1, wherein the respective handle axes are disposed in a common plane oriented substantially perpendicularly to the longitudinal axis.

10. A golf club handle apparatus according to claim 1, wherein the handles are spaced apart equidistantly from the shaft.

11. A golf club handle apparatus according to claim 10, wherein the handle structure includes a first attachment member and a second attachment member connected transversely to the first attachment member to form a T-shaped configuration, the first attachment member connected to the intermediate portion of the shaft with the second attachment member connected to respective ones of the pair of handles thereby forming a U-shaped configuration with the shaft positioned within the U-shaped configuration.

12. A golf club handle apparatus according to claim 11, wherein each of the pair of handles is connected to the second attachment member generally perpendicularly.

13. A golf club handle apparatus according to claim 11, wherein the handle structure includes a third attachment member and a fourth attachment member connected transversely to the third attachment member to form a T-shaped configuration, the third attachment member connected the intermediate portion of the shaft in linear alignment with the first attachment member with the fourth attachment member connected to respective ones of the pair of handles thereby forming a handle structure surrounding the shaft.

14. A golf club handle apparatus according to claim 13, wherein each one of the pair of handles is connected to the fourth attachment member generally perpendicularly.

15. A golf club handle apparatus according to claim 1, wherein the forearm support surface extends along an imaginary fall line inclined towards a selected one of the pair of handles whereby the imaginary fall line forms an acute angle relative to the longitudinal axis.

16. A golf club handle apparatus according to claim 15, wherein the forearm support member includes a cuff element configured to form a concavity sized and adapted to receive and contact a substantial portion of a user's inner forearm.

17. A golf club handle apparatus according to claim 16, wherein the forearm support member includes a spacer element connected to and between the first portion and the cuff element.

18. A golf club handle apparatus according to claim 15, wherein the forearm support member includes a sleeve sized and adapted to receive and surround a user's forearm.

19. A golf club handle apparatus according to claim 18, wherein the forearm support member includes a spacer element connected to and between the first portion and the sleeve.

20. A golf club handle apparatus according to claim 18, wherein the sleeve defines a forearm receiving channel having an enlarged opening and a reduced opening to form a truncated cone configuration with the reduced opening positioned between the selected handle and the enlarged opening.

21. A golf club handle apparatus according to claim 1, wherein the forearm support member is releasably connected to the shaft and operative, when released, to pivot about the longitudinal axis.

22. A golf club handle apparatus according to claim 21, wherein the shaft includes a toothed collar attached to and surrounding the shaft, the toothed collar including a plurality of radially extending gear teeth.

23. A golf club handle apparatus according to claim 22, wherein the forearm support member includes a tubular element connected to the spacer element opposite the cuff element and sized and adapted to slidably receive the shaft, the tubular element having a tubular end portion with a plurality of radially extending gear teeth adapted for mateable engagement with the plurality of gear teeth formed with the toothed collar.

24. A golf club handle apparatus according to claim 23, wherein the forearm support member includes a threaded cap and the shaft includes a threaded shaft end portion matably engageable with the threaded cap.

25. A golf club, comprising:

an elongated golf club shaft extending along a longitudinal axis and having a head section and a handle section disposed opposite the head section;

a golf club head connected to the head section; and a handle structure connected to the handle section having an upper handle portion and a lower handle portion with the lower handle portion disposed between the upper handle portion and the golf club head, the handle structure including a pair of handles connected to the lower handle portion and spaced apart from one another in a generally parallel relationship with the handle section of the golf club shaft positioned therebetween, the pair of handles disposed in a plane oriented generally perpendicularly to the longitudinal axis; and a forearm support member connected to the upper handle portion and having a forearm support surface spaced apart and facing away from the handle section of the golf club shaft.

26. A golf club according to claim 25, wherein the pair of handles are spaced apart equidistantly from handle section of the golf club shaft.

27. A golf club according to claim 25, wherein the forearm support member extends along an imaginary fall line inclined towards a selected one of the pair of handles whereby the imaginary fall line forms an acute angle relative to the longitudinal axis.

28. A golf club according to claim 27, wherein the forearm support member includes a cuff element configured to form a concavity sized and adapted to receive and contact a substantial portion of a user's inner forearm, the substantial portion of the user's forearm facing generally inwardly relative to the golf club shaft.

29. A golf club according to claim 28, wherein the forearm support member includes a spacer element connected to and between the upper handle portion and the cuff element.

30. A golf club according to claim 27, wherein the forearm support member includes a sleeve sized and adapted to receive and surround a user's forearm.

31. A golf club according to claim 30, wherein the forearm support member includes a spacer element connected to and between the upper handle portion and the sleeve.

32. A golf club according to claim 25, wherein the forearm support member is releasably connected to the upper handle portion and operative, when released, to pivot about the longitudinal axis.

* * * * *